United States Patent [19]

Kalina

[11] Patent Number: 4,548,043

[45] Date of Patent: Oct. 22, 1985

[54] METHOD OF GENERATING ENERGY

[76] Inventor: Alexander I. Kalina, 12214 Clear Fork, Houston, Tex. 77077

[21] Appl. No.: 665,042

[22] Filed: Oct. 26, 1984

[51] Int. Cl.[4] ..... F01K 25/06; F01K 25/10

[52] U.S. Cl. ..... 60/673

[58] Field of Search ..... 60/649, 673

[56] References Cited

U.S. PATENT DOCUMENTS 4,346,561 8/1982 Kalina ..... 60/673

4,489,563 12/1984 Kalina ..... 60/673

*Primary Examiner*—Allen M. Ostrager

*Attorney, Agent, or Firm*—Arnold, White & Durkee

[57] ABSTRACT

A method of generating energy in which working fluid fractions of differing compositions are generated, are subjected to heating in a first evaporator stage, are combined, the combined stream is then evaporated and is expanded to convert its energy into usable form. Thereafter the combined stream is processed to regenerate the differing working fluid fractions for reuse.

23 Claims, 5 Drawing Figures

METHOD OF GENERATING ENERGY

This invention relates to the generation of energy. More particularly, this invention relates to a method of transforming the energy of a heat source into usable form by using a working fluid which is expanded and regenerated. The invention further relates to a method of improving the heat utilization efficiency in a thermodynamic cycle and thus to a new thermodynamic cycle utilizing the method.

The most commonly employed thermodynamic cycle for producing useful energy from a heat source, is the Rankine cycle. In the Rankine cycle a working fluid such as water, ammonia or a freon is evaporated in an evaporator utilizing an available heat source. The evaporated gaseous working fluid is then expanded across a turbine to transform its energy into usable form. The spent gaseous working fluid is then condensed in a condenser using an available cooling medium. The pressure of the condensed working medium is then increased by pumping it to an increased pressure whereafter the working liquid at high pressure is again evaporated, and so on to continue with the cycle. While the Rankine cycle works effectively, it has a relatively low efficiency.

A thermodynamic cycle with an increased efficiency over that of the Rankine cycle, would reduce the installation costs per Kw. At current fuel prices, such an improved cycle would be commercially viable for utilizing various waste heat sources.

Applicants prior U.S. Pat. No. 4,346,561 filed Apr. 24, 1980 relates to a system for generating energy which utilizes a binary or multicomponent working fluid. This system, termed the Exergy system, operates generally on the principle that a binary working fluid is pumped as a liquid to a high working pressure. It is heated to partially vaporize the working fluid, it is flashed to separate high and low boiling working fluids, the low boiling component is expanded through a turbine to drive the turbine, while the high boiling component has heat recovered therefrom for use in heating the binary working fluid prior to evaporation, and is then mixed with the spent low boiling working fluid to absorb the spent working fluid in a condenser in the presence of a cooling medium.

Applicant's Exergy cycle is compared theoretically with the Rankine cycle in Applicant's prior patent to demonstrate the improved efficiency and advantages of Applicant's Exergy cycle. This theoretical comparison has demonstrated the improved effectiveness of Applicant's Exergy cycle over the Rankine cycle when an available relatively low temperature heat source such as surface ocean water, for example, is employed.

Applicant found, however, that Applicant's Exergy cycle provided less theoretical advantages over the conventional Rankine cycle when higher temperature available heat sources were employed.

Applicant then devised a further invention to provide an improved thermodynamic cycle for such applications. This invention utilizes a distillation system in which part of a working fluid is distilled to thereby assist in regeneration of the working fluid component. This invention is the subject matter of Applicant's prior patent application Ser. No. 405,942 which was filed on Aug. 6, 1982, now U.S. Pat. No. 4,489,563.

Applicant believes that a thermodynamic cycle can be improved if effective steps can be taken to reduce the effect of the pinch point problem when a working fluid is evaporated with a heating source.

It is accordingly one of the objects of this invention to provide a thermodynamic cycle in which the effect of the pinch point problem can be reduced.

In accordance with one aspect of this invention, a method of generating energy comprises:

(a) subjecting at least a portion of an initial composite stream having an initial composition of higher and lower boiling components, to distillation at an intermediate pressure in a distillation system to distill or evaporate part of the stream and thus generate an enriched vapor fraction which is enriched with a lower boiling component relatively to both a rich working fluid fraction and a lean working fluid fraction;

(b) mixing the enriched vapor fraction with part of the composite stream and absorbing it therein to produce at least one rich working fluid fraction which is enriched relatively to a composite working fluid with a lower boiling component;

(c) generating at least one lean working fluid fraction from part of the composite stream, the lean working fluid fraction being impoverished relatively to such a composite working fluid with a lower boiling component;

(d) using a remaining part of the initial composite stream as a condensation stream;

(e) condensing vapor contained in the rich and lean working fluid fractions to the extent that it is present in either;

(f) increasing the pressures of the rich and lean working fluid fractions in liquid form to a charged high pressure level;

(g) feeding the rich working fluid fraction and the lean working fluid fraction separately to a first evaporator stage to heat the lean working fluid fraction towards its boiling point, and to evaporate at least part of the rich working fluid fraction;

(h) mixing the lean and rich working fluid fractions to generate a composite working fluid;

(i) evaporating the composite working fluid in a second evaporator stage to produce a charged composite working fluid;

(j) expanding the charged composite working fluid to a spent low pressure level to transform its energy into usable form; and (k) condensing the spent composite working fluid in an absorption stage by cooling and absorbing it in the condensation stream at a pressure lower than the intermediate pressure to regenerate the initial composite stream.

The lean and rich working fluid fractions, to the extent that they are not generated in liquid form, are cooled to condense them, preferably completely or substantially completely, into liquid form before their pressures are increased to the charged high pressure level.

The rich and lean working fluid fractions will usually both require condensation to generate them in liquid form before they are pumped to the charged high pressure level.

In one embodiment of the invention the entire initial composite stream may be subjected to distillation in the distillation system to produce the enriched vapor fraction, and to produce a stripped liquid fraction from which the enriched vapor fraction has been stripped.

In one example of this embodiment of the invention the enriched vapor fraction may be divided into first and second enriched vapor fraction streams, and the stripped liquid fraction may be divided into first, second and third stripped liquid fraction streams. The first enriched vapor fraction stream may then be mixed with the first stripped liquid fraction stream to produce the rich working fluid fraction, the second enriched vapor fraction stream may be mixed with the second stripped liquid fraction stream to generate the lean working fluid fraction, and the third stripped liquid fraction stream may comprise the remaining part of the initial composite stream which is used as the condensation stream.

In an alternative example of this embodiment of the invention, the stripped liquid fraction may be divided into first, second and third stripped liquid fraction streams, the enriched vapor fraction may be mixed with the first stripped liquid fraction stream to produce the rich working fluid fraction, the second stripped liquid fraction stream may be used as the part of the initial composite stream comprising the lean working fluid fraction, and the third stripped liquid fraction stream may be used as the remaining part of the initial composite stream to constitute the condensation stream.

In an alternative embodiment of the invention, only portion of the initial composite stream may be subjected to distillation in the distillation system to produce the enriched vapor fraction, and to produce a stripped liquid fraction from which the enriched vapor fraction has been stripped.

In this embodiment of the invention the enriched vapor fraction may, for example, be divided into first and second enriched vapor fraction streams and the stripped liquid fraction may be used to constitute or comprise the condensation stream. In this example of the invention, the remaining part of the initial composite stream which is not subjected to distillation may be divided, for example, into first and second composite streams. The first and second enriched vapor fraction streams may be mixed with the first and second composite streams respectively to produce the rich working fluid fraction and the lean working fluid fraction.

It will readily be appreciated that depending upon conditions and circumstances including available heating and cooling sources, the rich and lean working fluid fractions may be generated by mixing varying proportions of the enriched vapor fraction with varying proportions of one or more stripped liquid fractions, one or more initial composite stream fractions which are not subjected to distillation, or by making any combination which will achieve the desired rich and lean working fluid fractions for reducing the pinch point problem in accordance with this invention.

It will further be appreciated that by making appropriate selections from the enriched vapor fraction, from the stripped liquid fraction and from the initial composite stream two, three or more working fluid fractions may be produced which have a range of low boiling component concentrations and which are of appropriate quantities to allow effective separate heating in a first evaporator stage, followed by combining two or more of the streams, followed by separate heating in a subsequent evaporator stage, again followed by mixing of the fluid streams to reduce the number of streams, again followed by evaporation in a subsequent evaporator stage, and so on until a single composite working fluid has been produced which can then be evaporated and expanded to convert its energy into usable form.

In a preferred embodiment of the invention, the condensation stream will be throttled down to the pressure of the spent composite working fluid for absorbing the spent composite working fluid therein in the absorption stage.

The condensation stream and the spent composite working fluid may be cooled in the absorption stage utilizing any appropriate and available cooling medium.

The initial composite stream generated in the absorption stage, or the portion thereof which is to be subjected to distillation, may be subjected to distillation by heating in one or more heat exchangers using any suitable and available heating medium.

Applicant's presently preferred method of subjecting the initial composite stream, or portion thereof, to distillation is by means of relatively low temperature heat. This provides the advantage that the quantity of heat loss in the heat exchanger system will be substantially less, and that low temperature heat may be used for this purpose which cannot conveniently be utilized in other aspects of the cycle.

In a presently preferred embodiment of the invention, distillation may be effected by passing the initial composite stream, or portion thereof, in heat exchange relationship with one or more of the following heating sources:

(a) the spent composite working fluid;
(b) the condensation stream;
(c) the lean working fluid fraction;
(d) the rich working fluid fraction; and
(e) an auxiliary heating source.

Applicant believes that in many applications of the cycle of this invention, no auxiliary heating source will be required. Applicant thus believes that sufficient heat can be extracted from the spent composite working fluid, from the condensation stream, and from the lean and rich working fluid fractions to provide for effective distillation or evaporation of part of the initial composite stream to produce the enriched vapor fraction which is enriched with respect to the lower boiling component or components of the composite stream.

When the initial composite stream is subjected to such distillation, the lower boiling component or components will naturally evaporate or distill first thereby producing the enriched vapor fraction.

The compositions of the rich working fluid and lean working fluid fractions are preferably selected so that they can be heated most effectively in the first evaporator stage with the available heating medium. The first evaporator stage will generally be the low temperature stage of the evaporator.

Thus, for example, the composition should be selected, and the relative quantities should be selected, such that the lean working fluid fraction will be heated towards its boiling point in the first evaporator stage, while the rich working fluid fraction will be heated towards its saturated vapor stage.

Preferably the rich working fluid fraction should be enriched as much as possible with the lower boiling component or components, consistent with the use of a lean working fluid fraction which can have a boiling point at the dew point of the rich working fluid fraction.

In a presently preferred embodiment, the compositions and quantities will be selected so that the lean working fluid will be heated to its boiling point or to substantially its boiling point in the first evaporator stage, while the rich working fluid fraction will be evaporated substantially or completely to be in the form of a saturated vapor in the first evaporator stage.

While both the lean working fluid fraction and the rich working fluid fraction may be heated to a higher temperature in the first evaporator stage, Applicant believes that this will not provide any real thermodynamic advantage in the cycle of this invention.

The rich and lean working fluid fractions are thus selected so that after they have passed through the first evaporator stage, they are substantially or at least generally in equilibrium both in temperature and pressure to reduce any thermodynamic losses which may occur during mixing.

When lean and rich working fluid fractions are first generated in accordance with this invention, they will usually both contain vapor and must therefore be cooled to condense them completely. They are then pumped separately to the charged high pressure level before being fed to the first evaporator stage. While the lean working fluid fraction may sometimes contain no vapor and will therefore not have to be cooled, the rich working fluid fraction will usually contain vapor and will have to be cooled to condense the vapor and provide the fraction in liquid form for effective pressure increase.

They may be cooled utilizing any available cooling medium. In accordance with Applicant's presently preferred embodiment of the invention, the lean working fluid fraction will be cooled by passing it in heat exchange relationship with the initial composite stream which is being subjected to distillation.

Similarly, in accordance with Applicant's presently preferred embodiment, the rich working fluid fraction will be cooled by passing it in heat exchange relationship with an auxiliary cooling source. A preheater system may also be employed between the cooled rich working fluid fraction and the rich working fluid fraction which has not yet been cooled with the cooling medium of the auxiliary cooling source.

In the preferred application of the invention, the rich and lean working fluid fractions will be cooled so that their temperatures will be generally equal or close before they are fed to the first evaporator stage.

After the lean and rich working fluid fractions have passed through the first evaporator stage, and have been mixed to constitute the composite working fluid, they may be heated in the second evaporator stage to evaporate the composite working fluid completely or at least substantially completely.

Applicant believes that the best thermodynamical advantages will be provided if the composite working fluid is evaporated completely in the second evaporator stage. Applicant believes that it will be less advantageous if the composite working fluid is not evaporated completely.

If the composite working fluid is evaporated only partially, some of that fluid, which will have been heated to a relatively high temperature, will not be available to generate energy. This will therefore reduce the efficiency of the process. By evaporating the composite working fluid completely in the second evaporation stage using a relatively high temperature heat, and utilizing all or substantially all of the evaporated composite working fluid as the charged composite working fluid, Applicant believes that high temperature energy utilization will be the most efficient and effective.

In a presently preferred embodiment of the invention, the composite working fluid from the second evaporator stage, will be superheated in a superheater stage.

The charged composite working fluid may be expanded to a spent low pressure level to transform its energy into usable form, utilizing any suitable and available device for this purpose. Devices of this nature are generally in the form of turbines and will generically be referred to in the specification as turbines.

Various single and multi-stage turbines are available and can be selected to provide the appropriate pressure and temperature ranges for effective utilization of this invention.

In an embodiment of the invention a multi-stage turbine system may be used, and at least part of the composite working fluid may be recycled to the superheater stage after passing through a high pressure stage of the turbine, and before entering a low pressure stage of the turbine.

It will readily be appreciated by those skilled in the art that relatively low temperature heat for the distillation system of this invention may be obtained from various sources depending upon circumstances. It may be obtained in the form of spent relatively high temperature heat, in the form of the lower temperature part of relatively higher temperature heat from a heat source, in the form of relatively lower temperature waste or other heat which is available from the or from a heat source, and/or in the form of relatively lower temperature heat which is generated in the method of this invention and cannot be utilized efficiently or more effectively or at all for evaporation of the composite working fluid.

Various types of heat sources may be used in the evaporator stage of the cycle of this invention to evaporate the composite working fluid. In each instance, depending upon available heat sources, the cycle can be adjusted to utilize such heat sources in the most effective manner. For example, Applicant anticipates that heat sources may be used from sources as high as 1,000° F. or more, down to heat sources such as those obtained from ocean thermal gradients. Heat sources such as, for example, low grade primary fuel, waste heat, geothermal heat, solar heat and ocean thermal energy conversion systems are believed all to be capable of development for use in this invention.

The working fluid for use in this invention may be any multi-component working fluid which comprises a mixture of two or more low and high boiling fluids. The fluids may be mixtures of any of a number of compounds with favorable thermodynamic characteristics and having an appropriate or wide range of solubility. Thus, for example, the working fluid may comprise a binary fluid such as an ammonia-water mixture, two or more hydrocarbons, two or more freons, mixtures of hydrocarbons and freons, or the like.

Applicant's presently preferred working fluid is a water-ammonia mixture.

Enthalpy-concentration diagrams for ammonia-water are readily available and are generally accepted. The National Bureau of Standards will supply upon request an article published in the National Bureau of Standards list as Project 758-80. This paper was prepared by Wiltec Research Company, Inc., 488 South 500 West, Provo, Utah, 84601 in 1983 and deals with the experimental study of water-ammonia mixtures and their properties in a wide range of temperatures and pressures. A copy of this paper is attached to this specification and is incorporated herein by reference.

Ammonia-water provides a wide range of boiling temperatures and favorable thermodynamic characteristics. Ammonia-water is therefore a practical and potentially useful working fluid in many applications of this invention. Applicant believes, however, that when equipment economics and turbine design become paramount considerations in developing commercial embodiments of the invention, mixtures of freon-22 with toluene or other hydrocarbon or freon combinations will become more important for consideration.

In general, standard equipment may be utilized in carrying out the method of this invention. Thus, equipment such as heat exchangers, tanks, pumps, turbines, valves and fittings of the type used in typical thermodynamic cycles such as, for example, Rankine cycles, may be employed in carrying out the method of this invention. Applicant believes that the constraints upon materials of construction would be the same for this invention as for conventional Rankine cycle power or refrigeration systems. Applicant believes, however, that higher thermodynamic efficiency of this invention will result in lower capital cost per unit of useful energy recovered, primarily saving in the cost of heat exchanger and boiler equipment. Applicant believes that this invention will provide a reduction in the total cost per unit of energy produced.

The invention is now described in detail with reference to certain preferred embodiments invention and with reference to the accompanying drawings.

Figure 1:
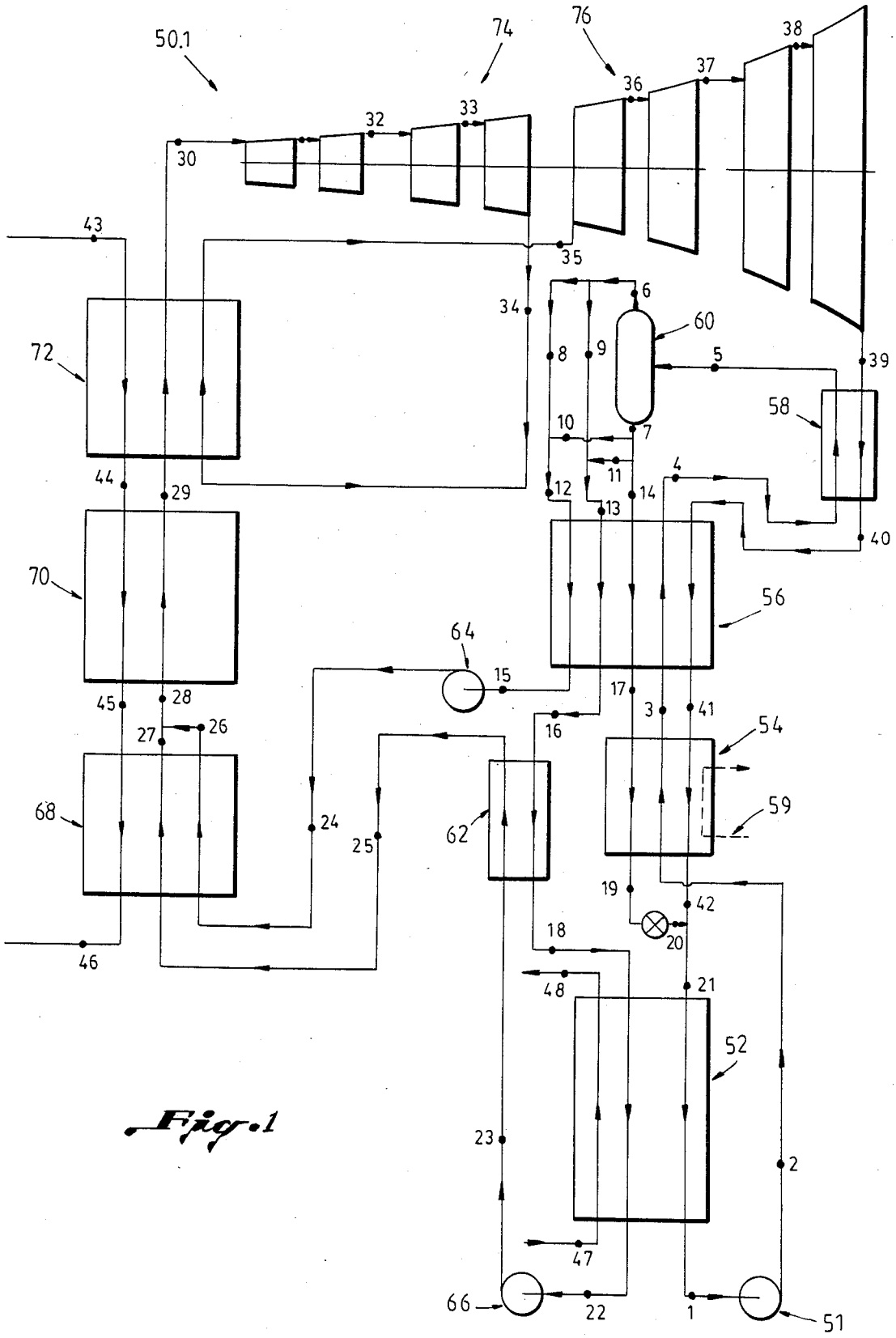
FIG. 1 shows a schematic representation of one system for carrying out the method of this invention.

With reference to FIG. 1 of the drawings, reference numeral 50.1 refers generally to one embodiment of a thermodynamic system or cycle in accordance with this invention.

The system of cycle 50.1 comprises an absorption stage 52, a heat exchanger 54, a recuperator 56, a main heat exchanger 58, a separator stage 60, a preheater 62, pumps 64 and 66, a first evaporator stage 68, a second evaporator stage 70, a superheater section 72, and a multi-stage turbine comprising a high pressure stage 74 and a low pressure stage 76.

The system or cycle of this invention will now be described by way of example by reference to the use of an ammonia-water working solution as the initial composite stream.

This is a continuous system where a charged composite working fluid is expanded to convert its energy into usable form, and is then continually regenerated. A substantially constant and consistent quantity of composite working fluid will therefore be maintained in the system for long term use of the system.

In analyzing the system it is useful to commence with the point in the system identified by reference numeral 1 comprising the initial composite stream having an initial composition of higher and lower boiling components in the form of ammonia and water. At point 1 the initial composite stream is at a spent low pressure level. It is pumped by means of a pump 51 to an intermediate pressure level where its pressure parameters will be as at point 2 following the pump 51.

From point 2 of the flow line, the initial composite stream at an intermediate pressure is heated consecutively in the heat exchanger 54, in the recuperator 56 and in the main heat exchanger 58.

The initial composite stream is heated in the heat exchanger 54, in the recuperator 56 and in the main heat exchanger 58 by heat exchange with the spent composite working fluid from the turbine sections 74 and 76. In addition, in the heat exchanger 54 the initial composite stream is heated by the condensation stream as will be hereinafter described. In the recuperator 56 the initial composite stream is further heated by the condensation stream and by heat exchange with lean and rich working fluid fractions as will be hereinafter described.

The heating in the main heat exchanger 58 is performed only by the heat of the flow from the turbine outlet and, as such, is essentially compensation for under recuperation.

At point 5 between the main heat exchanger 58 and the separator stage 60 the initial composite stream has been subjected to distillation at the intermediate pressure in the distillation system comprising the heat exchangers 54 and 58 and the recuperator 56. If desired, auxiliary heating means from any suitable or available heat source may be employed in any one of the heat exchangers 54 or 58 or in the recuperator 56. This is shown, for example, by dotted line 59 in the heat exchanger 54.

At point 5 the initial composite stream has been partially evaporated in the distillation system and is sent to the gravity separator stage 60. In this stage 60 the enriched vapor fraction which has been generated in the distillation system, and which is enriched with the low boiling component, namely ammonia, is separated from the remainder of the initial composite stream to produce an enriched vapor fraction at point 6 and a stripped liquid fraction at point 7 from which the enriched vapor fraction has been stripped.

In the embodiment illustrated in FIG. 1, the enriched vapor fraction from point 6, is divided into first and second enriched vapor fraction streams as at points 9 and 8 respectively.

Further, in the FIG. 1 embodiment, the stripped liquid fraction from point 7 is divided into first, second and third stripped liquid fraction streams having parameters as at points 11, 10 and 14 respectively.

The enriched vapor fraction at point 6 is enriched with the lower boiling component, namely ammonia, relatively to both a rich working fluid fraction and a lean working fluid fraction as discussed below.

The first enriched vapor fraction stream from point 9 is mixed with the first stripped liquid fraction stream at point 11 to provide a rich working fluid fraction at point 13.

The second enriched vapor fraction stream at point 8 is mixed with the second stripped liquid fraction stream at point 10 to produce a lean working fluid fraction at point 12.

The rich working fluid fraction is enriched relatively to the composite working fluid (as hereinafter discussed) with the lower boiling component comprising ammonia. The lean working fluid fraction, on the other hand, is impoverished relatively to the composite working fluid (as hereinafter discussed) with respect to the lower boiling component.

The third stripped liquid fraction at point 14 comprises the remaining part of the initial composite stream and is used to constitute the condensation stream.

The difference in composition of the lean and rich working fluid fractions at points 12 and 13 is achieved by using difference proportions of vapor to liquid in forming these two fractions.

The lean working fluid fraction is cooled between points 12 and 15 in the recuperator 56 to condense it completely and provide a condensed lean working fluid fraction at point 15.

The rich working fluid fraction at point 13 is partially condensed in the recuperator 56 to point 16. Thereafter the rich working fluid fraction is further cooled and condensed in the preheater 62 (from point 16 to 18), and is finally condensed in the absorption stage 52 by means of heat exchange with a cooling water supply through points 47 to 48.

The lean working fluid fraction at point 15 is then pumped to a charged high pressure level by means of the pump 64 to provide it with parameters as at point 24. Likewise the rich working fluid fraction is pumped to the same or substantially the same charged high pressure level by means of the pump 66. Thereafter it passes through the preheater 62 to arrive at point 25 where it is substantially at the same pressure and temperature as the lean working fluid fraction which is at point 24.

In practice the temperatures at points 24 and 25 should be sufficiently high to prevent water precipitation on the surface of the tubes in the evaporator stage 68.

The flows at points 24 and 25 are then fed separately to the first evaporator stage 68. This is the low temperature stage of the evaporator system where the rich and lean working fluid fractions are heated with the lower temperature portion of a heating source supplied originally from point 43 at high temperature, and leaving the system at point 46.

In the first evaporator stage 68 the rich working fluid fraction is preferably heated from point 25 to point 27 so that it is evaporated entirely and is preferably, at point 27, in the form of a saturated vapor at its dew point. Applicant believes that this will be the most effective heat utilization in the first evaporator stage 68 and that while the rich working fluid fraction could be heated to a lower or higher temperature in this stage, this will provide no advantage and may lead to losses.

The lean working fluid fraction is likewise heated in the first evaporator stage 68 from point 24 to point 26. This is preferably heated such that the lean working fluid fraction is heated to or substantially to its boiling point by the time it reaches point 26. Again Applicant believes that this will be the most effective utilization of heat in relation to the lean working fluid fraction in the first evaporator stage 68, and that heating to a lower or higher temperature will reduce the efficiency of the cycle.

The lean and rich working fluid fractions 26 and 27 are then mixed to form, at point 28, a composite working fluid. When they are mixed they are in thermodynamical equilibrium both in regard to temperature and pressure. Thermodynamical losses on mixing should therefore be very low.

The charged composite working fluid from point 28 is then fed through the second evaporator stage 70 where it is preferably evaporated completely to produce the charged composite working fluid in gaseous form. This is at point 29. From point 29 to point 30 the charged composite working fluid is superheated in the superheater stage 72.

The composite working fluid, with parameters at point 30 is then sent through the high pressure stage 74 of the turbine to transform its energy into usable form.

Both the high pressure stage 74 and the low pressure stage 76 of the turbine are shown to comprise four separate stages. Any appropriate turbine system may, however, be used instead.

After passing through the high pressure stage 74 of the turbine the composite working fluid has parameters as at point 34, with a lower pressure and lower temperature than it had at point 30. From point 34 the composite working fluid is sent back into the superheater section 72 of the evaporator stage, where it is reheated from point 34 to point 35 and is then fed into the low pressure stage 76 of the turbine, where it is fully expanded until it reaches the spent low pressure level at point 39. At point 39 the composite working fluid preferably has such a low pressure that it cannot be condensed at this pressure and at the available ambient temperature. From point 39 the spent composite working fluid flows through the main heat exchanger 58, through the recuperator 56 and through the heat exchanger 54. Here it is partially condensed and the released heat is used to preheat the incoming flow as previously discussed.

The spent composite working fluid at point 42 is then mixed with the condensation stream at point 20. At point 20 the condensation stream has been throttled from point 19 to reduce its pressure to the low pressure level of the spent composite working fluid at point 42. The resultant mixture is then fed from point 21 through the absorption stage 52 where the spent composite working fluid is absorbed in the condensation stream to regenerate the initial composite stream at point 1.

Figure 2:
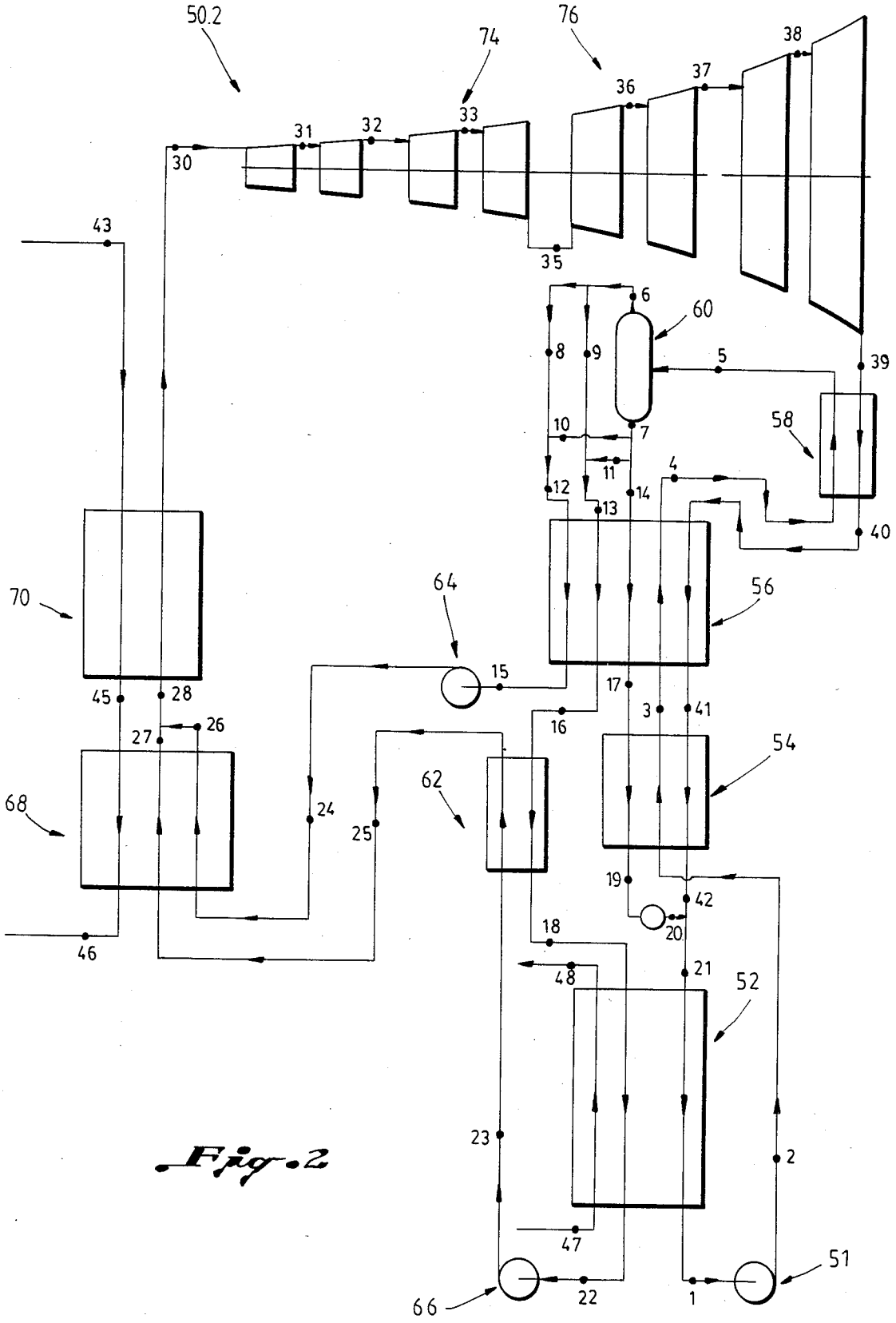
FIG. 2 shows a schematic representation of the system of FIG. 1, but with the superheating stage omitted.

With reference to FIG. 2 of the drawings, reference numeral 50.2 refers generally to an alternative embodiment of an energy system or cycle in accordance with this invention.

The system 50.2 corresponds in all respects with the system 50.1, except that the superheater stage 72 of FIG. 1 has been omitted, and that there is no recycle of the partially expanded composite working fluid through such a superheater stage.

Figure 3:
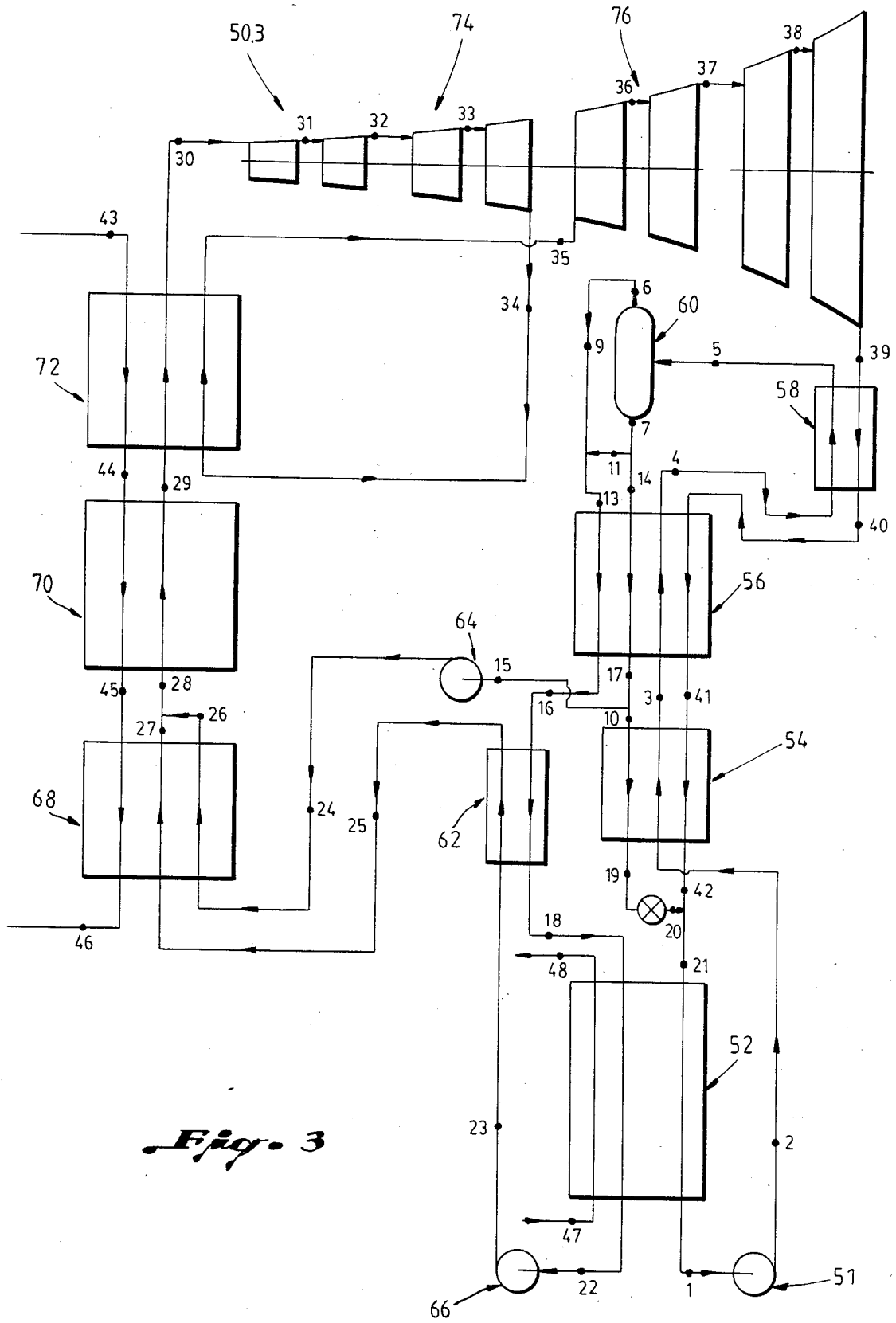
FIG. 3 shows a schematic representation of an alternative embodiment of this invention.

With reference to FIG. 3 of the drawings, reference numeral 50.3 refers to yet a further alternative embodiment of a system or cycle in accordance with this invention.

The system 50.3 corresponds substantially with the system 50.1 of FIG. 1, and corresponding parts are identified with corresponding reference numerals.

In the system 50.3 the stripped liquid fraction at point 7 is divided into first, second and third stripped liquid fractions at points 11, 15 and 10 respectively. Further, in this embodiment, only one enriched vapor fraction is produced at point 6. It is not split into two vapor fraction streams as in the case of the cycles 50.1 and 50.2.

The enriched vapor fraction at point 9 is mixed with the first stripped liquid fraction stream from point 11 to produce the rich working fluid fraction at point 13.

The rich working fluid fraction at point 13 is condensed and cooled in the same way as discussed with reference to FIG. 1 through the recuperator 56, the preheater 62 and the absorption stage 52. It is then pumped to the charged high pressure level by means of the pump 66, passes through the preheater 62 and arrives at point 25.

The second stripped liquid fraction stream is obtained at point 15 after passing, together with the third stripped liquid fraction stream, through the recuperator 56. After point 17, the second and third stripped liquid fraction streams are split with the one being conveyed to point 15 to constitute the lean working fluid fraction. The third stripped liquid fraction stream from point 10 passes through the heat exchanger 54, is throttled from point 19 to point 20 to reach the spent low pressure level, and thus constitutes the condensation stream for absorbing the spent composite working fluid from point 42 in the absorption stage 52.

The lean working fluid fraction at point 15 is pumped to the charged high pressure level by means of the pump 64 and arrives at point 24 where it has substantially the same pressure and temperature parameters as the rich working fluid fraction at point 25.

The remainder of the process is then exactly the same as described with reference to FIG. 1.

Figure 4:
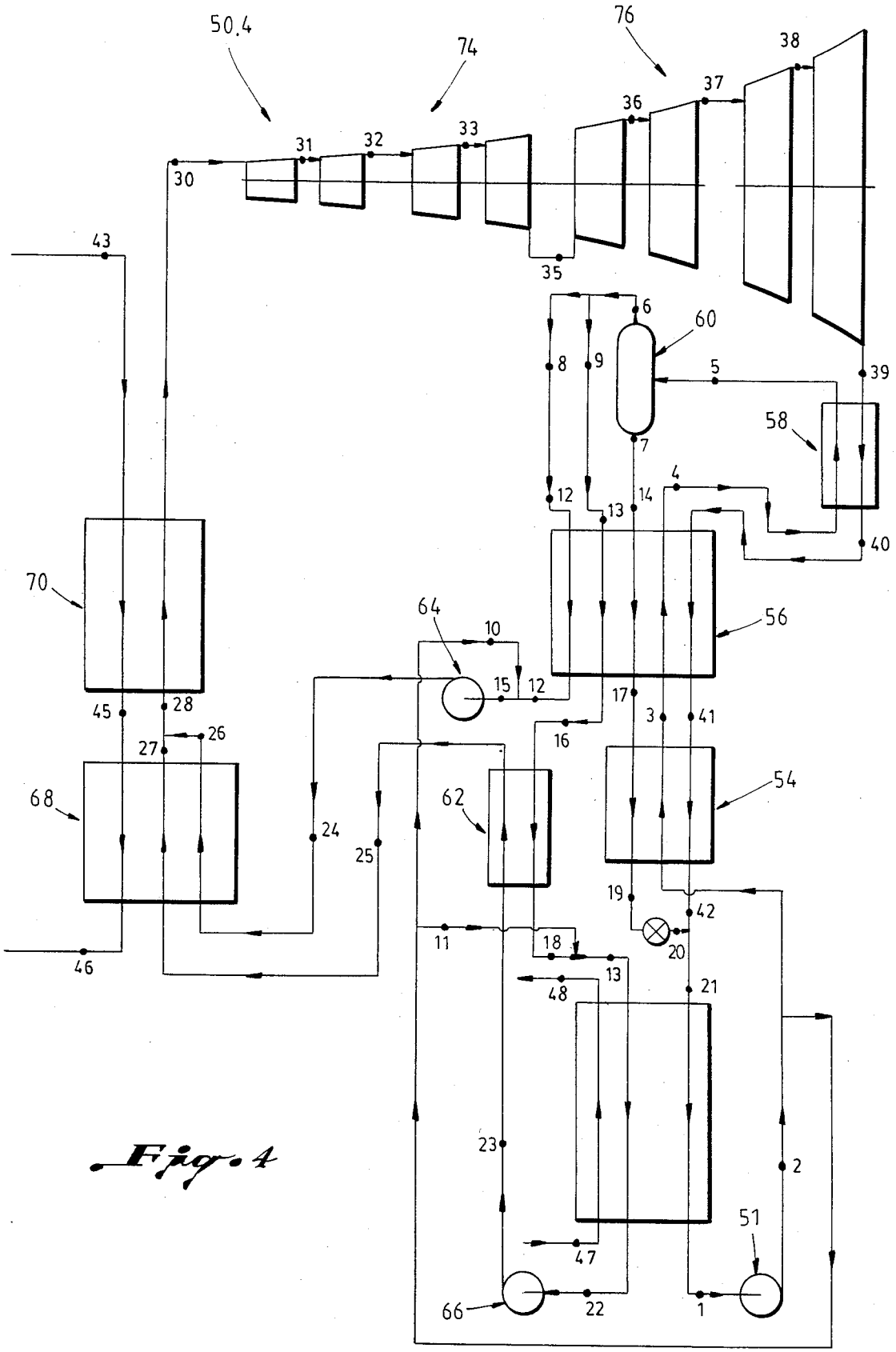
FIG. 4 shows a schematic representation of yet a further alternative embodiment in accordance with this invention.

With reference to FIG. 4 of the drawings, reference numeral 50.4 refers to yet a further alternative embodiment of a thermodynamic system or cycle in accordance with this invention.

The cycle 50.4 corresponds generally with the cycle 50.2 and thus with the cycle 50.1 as illustrated in FIGS. 2 and 1 of the drawings. Corresponding parts are therefore indicated by corresponding reference numerals.

In the system 50.4, unlike the embodiments of the previous figures, only portion of the initial composite stream which is at the intermediate pressure at point 2 is subjected to distillation in the distillation stage.

In the system 50.4 the enriched vapor fraction at point 6 is again, as in the case of the system 50.1, divided into first and second enriched vapor fraction streams at points 9 and 8 respectively. These streams flow through the recuperator 56 where they are cooled for partial condensation.

The stripped liquid fraction from point 7, comprises the condensation stream. It flows from point 14 through the recuperator 56 to point 17, through the heat exchanger 54 to point 19, and then through the throttle valve to point 20 to absorb therein, in the absorption stage 52, the spent composite working fluid to regenerate the initial composite stream at point 1 as described with reference to FIG. 1.

After point 2 the remaining part of the initial composite stream which is not subjected to distillation in the distillation system, is extracted and divided into first and second composite streams 11 and 10 respectively.

The second enriched vapor fraction stream from point 8, after passing through the recuperator 56, is mixed with the second composite stream from point 10, to constitute the lean working fluid fraction at point 15. This is then again pumped by means of the pump 64 to the charged high pressure level to yield the lean working fluid fraction at point 24.

The first enriched vapor fraction stream from point 9 is fed through the recuperator 56 and through the preheater 62. Thereafter, from point 18, it is mixed with the first composite stream from point 11. This then yields the rich working fluid fraction at point 13 which passes through the absorption stage 52, through the pump 66, and through the preheater 62 to arrive at point 25 with the appropriate temperature and pressure parameters.

As in the case of the embodiment of FIG. 1, these two streams then pass through the first absorption stage, are then mixed at point 28, and are then evaporated in the second absorption stage 70.

The embodiment illustrated in FIG. 4 corresponds with the cycle 50.2. It may also, of course, include a superheater stage 72 and a recycle loop 34 to 35 as illustrated in FIG. 1.

Persons of ordinary skill in this art will appreciate that for appropriate circumstances and conditions, a plurality of lean working fluid fractions or rich working fluid fractions can be generated by selecting quantities of enriched vapor fractions from zero up, and by selecting stripped liquid fractions and/or initial composite stream fractions in appropriate quantities as may be desired.

Figure 5:
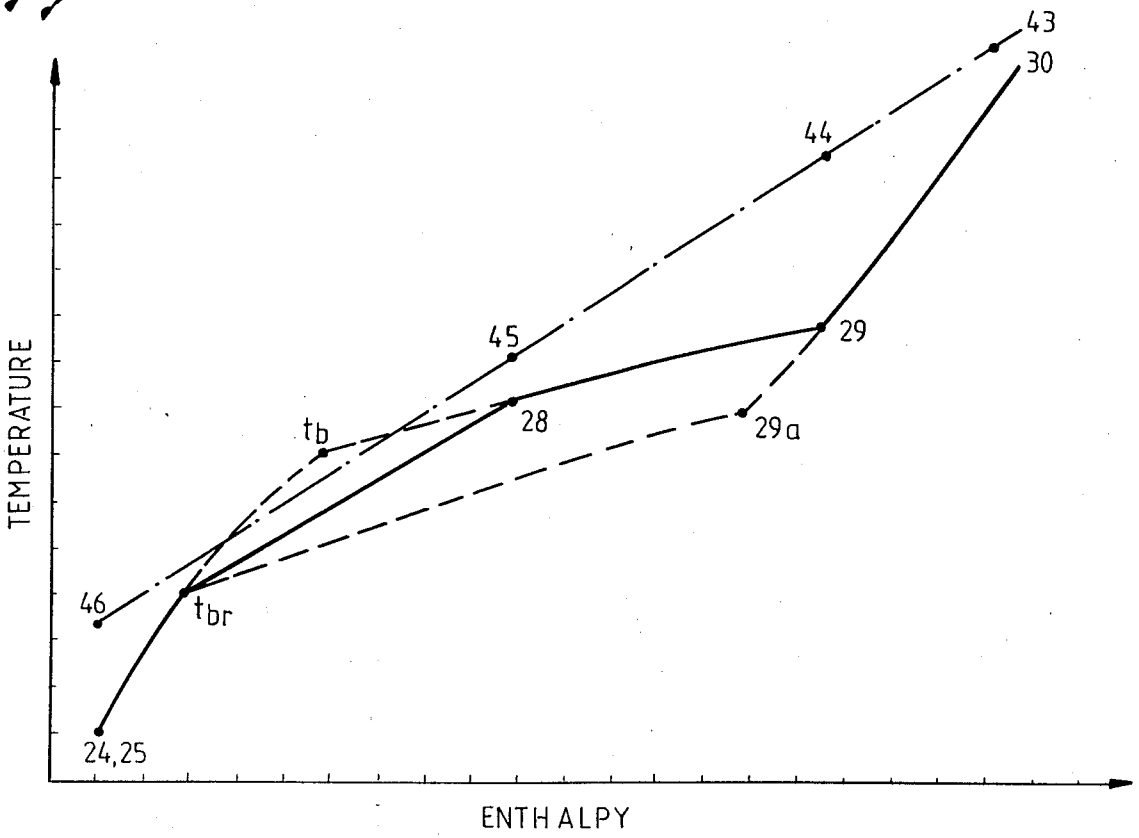
FIG. 5 is a graphic representation of a temperature-/enthalpy diagram to demonstrate how application of this invention can reduce the pinch point problem.

Applicant will now, without wishing to bound by theory, try to explain the theoretical basis for this invention with reference to the graph of FIG. 5. In this graph temperature is plotted against enthalpy for what Applicant believes would be a typical water-ammonia system in accordance with this invention. The points given in this graph correspond with the points used for the various parameters in the cycle 50.1 of FIG. 1.

The first evaporator stage 68 or the low temperature evaporator stage 68 can be considered as being divided into two portions. In the first portion the rich working fluid fraction and the lean working fluid fraction are heated from points 25 and 24 respectively up to the point designated $t_{br}$. Both the rich and the lean working fluid fractions are below their boiling points. In the second part of the first evaporator stage 68, beyond the point $t_{br}$ the temperatures of both the rich and lean working fluid fractions are above their bubble point temperatures.

If one were to introduce into the first separation stage only the rich working fluid fraction at its given pressure, such a fluid would begin to boil at point $t_{br}$. This is a relatively low temperature and will permit the use of the available heat source in full. However, the whole boiling process will take place at a relatively low temperature which would result in increased temperature differences in most parts of the evaporator stage and consequently would result in relatively high thermodynamic losses. This theoretical process is shown in FIG. 5 by the line between point 25 and $t_{br}$, by the dotted line from point $t_{br}$ to point 29*a* and by the dotted line from point 29*a* to point 29.

The cooling of the heat source is designated with a chain dotted line from point 43 through to point 46.

If a person were now trying to introduce the composite working fluid, comprising the mixture of the rich working fluid fraction at point 25 and the lean working fluid fraction at point 24, at the same given pressure, while trying to use the available heat source in full, this fluid would only begin to boil at a temperature $t_b$. This is a temperature which is higher than the temperature of the heat source in the corresponding part of the evaporator stage 68. This would consequently make the process impossible. This impossible process is demonstrated in FIG. 5 by the line 24-$t_{br}$-$t_b$-28-29. Such a process would only be possible if incomplete use is made of the available heat source and the corresponding thermodynamic losses are incurred.

When, however, the rich working fluid fraction and lean working fluid fraction are introduced separately into the first evaporation stage 68 in accordance with this invention, the rich working fluid fraction will start to boil at the relatively low temperature $t_{br}$, thereby reducing the "pinch point" problem. At the same time, because the rich working fluid fraction and lean working fluid fraction have been combined at point 28, when they are in thermodynamical equilibrium, the boiling process will take place at a relatively high temperature. The thermodynamic losses are therefore reduced. This, in turn, permits the system to accommodate an increased pressure in the evaporator stage and consequently at the turbine inlet. This combined process is shown in FIG. 5 by the solid line 24–29.

This resultant summary of the enthalpy of the two systems, demonstrates that the curve followed by the system of this invention through the first evaporator stage 68, is further away from the heating medium line in the pinch point zone to thereby reduce the pinch point problem, while it approaches the heating medium line more closely after point 28 to reduce the thermodynamic losses.

Applicant believes that by using more than two working fluid fractions of varying composition which are combined in successive stages as they pass through successive evaporator stages, and by using superheating in an effective number of stages, the heating curve of the working fluid fraction can be smoothened to approach that of the heating fluid more closely and thereby lead to a reduction in thermodynamic losses.

In certain embodiments of the invention where the composite working fluid has been expanded from a very high pressure to a spent low pressure level, the working fluid may, at point 39, have a temperature which is too low. It may also have a significant content of condensed liquid. As a result it can have an adverse effect on the performance of the last stages of the turbine 76. In addition, the quantity and quality of heat remaining in this stream after point 39 may not be sufficient to provide for distillation of the initial composite stream and thus for regeneration of the working fluid fraction. Applicant believes that this potential disadvantage may overcome by the superheater stage 72 and by the recycle loop as employed between points 34 and 35 in FIGS. 1 and 3.

I claim:

1. A method of generating energy which comprises:

(a) subjecting at least a portion of an initial composite stream having an initial composition of higher and lower boiling components, to distillation at an intermediate pressure in a distillation system to distill or evaporate part of the stream and thus generate an enriched vapor fraction which is enriched with a lower boiling component relatively to both a rich working fluid fraction and a lean working fluid fraction;

(b) mixing the enriched vapor fraction with part of the composite stream and absorbing it therein to produce at least one rich working fluid fraction which is enriched relatively to a composite working fluid with a lower boiling component;

(c) generating at least one lean working fluid fraction from part of the composite stream, the lean working fluid fraction being impoverished relatively to such a composite working fluid with a lower boiling component;

(d) using a remaining part of the initial composite stream as a condensation stream;

(e) condensing vapor contained in the rich and lean working fluid fractions to the extent that it is present;

(f) increasing the pressures of the rich and lean working fluid fractions in liquid form to a charged high pressure level;

(g) feeding the rich working fluid fraction and the lean working fluid fraction separately to a first evaporator stage to heat the lean working fluid fraction towards its boiling point, and to evaporate at least part of the rich working fluid fraction;

(h) mixing the lean and rich working fluid fractions to generate a composite working fluid;

(i) evaporating the composite working fluid in a second evaporator stage to produce a charged composite working fluid;

(j) expanding the charged composite working fluid to a spent low pressure level to transform its energy into usable form; and (k) condensing the spent composite working fluid in an absorption stage by cooling and absorbing it in the condensation stream at a pressure lower than the intermediate pressure to regenerate the initial composite stream.

2. A method according to claim 1, in which the lean and rich working fluid fractions, to the extent that they are not generated in liquid form, are cooled to condense them into liquid form before their pressures are increased to the charged high pressure level.

3. A method according to claim 1, in which the entire initial composite stream is subjected to distillation in the distillation system to produce the enriched vapor fraction, and to produce a stripped liquid fraction from which the enriched vapor fraction has been stripped.

4. A method according to claim 3, in which the enriched vapor fraction is divided into first and second enriched vapor fraction streams, in which the stripped liquid fraction is divided into first, second and third stripped liquid fraction streams, in which the first enriched vapor fraction stream is mixed with the first stripped liquid fraction stream to produce the rich working fluid fraction, in which the second enriched vapor fraction stream is mixed with the second stripped liquid fraction stream to generate the lean working fluid fraction, and in which the third stripped liquid fraction stream comprises the remaining part of the initial composite stream which is used as the condensation stream.

5. A method according to claim 4, in which the condensation stream is throttled down to the pressure of the spent composite working fluid for absorbing the spent composite working fluid therein.

6. A method according to claim 5, in which the condensation stream and the spent composite working fluid are cooled in the absorption stage with an available cooling medium, and in which the initial composite stream generated in the absorption stage is subjected to distillation by heating it in heat exchangers using one or more of the following heating sources:

(a) the spent composite working fluid;

(b) the condensation stream;

(c) the lean working fluid fraction;

(d) the rich working fluid fraction; and (e) an auxiliary heating source.

7. A method according to claim 6, in which the auxiliary heating source, when used, is a relatively low temperature source.

8. A method according to claim 4, in which the compositions of the rich working fluid and lean working fluid fractions are selected so that when heated in the first evaporator stage, the lean working fluid fraction will substantially reach its boiling point, and the rich working fluid fraction will be substantially in the form of a saturated vapor.

9. A method according to claim 4, in which the lean and the rich working fluid fractions are cooled in heat exchangers to condense them completely, and are then pumped separately to the charged high pressure level before being fed to the first evaporator stage.

10. A method according to claim 9, in which the lean working fluid fraction is cooled by passing it in heat exchange relationship with the initial composite stream.

11. A method according to claim 9, in which the rich working fluid fraction is cooled by passing it in heat exchange relationship with an auxiliary cooling source.

12. A method according to claim 11, in which the rich working fluid fraction is further cooled by passing it in heat exchange relationship with one or more of the following cooling sources:

(a) the initial composite stream; and (b) the cooled condensed rich working fluid fraction.

13. A method according to claim 9, in which the rich and lean working fluid fractions are cooled so that their temperatures will be generally equal or close before they are fed to the first evaporator stage.

14. A method according to claim 1, in which the composite working fluid produced by mixing the lean and rich working fluid fractions, is heated in the second evaporator stage to evaporate the composite working fluid substantially completely.

15. A method according to claim 1, in which the composite working fluid produced by mixing the lean and the rich working fluid fractions, is heated in the second evaporator stage to substantially its dew point.

16. A method according to claim 8, in which the composite working fluid produced by mixing the lean and rich working fluid fractions, is heated in the second evaporator stage to evaporate the composite working fluid substantially completely.

17. A method according to claim 1, in which the composite working fluid from the second evaporator stage is superheated in a superheater stage.

18. A method according to claim 17, in which the superheated composite working fluid is expanded in a multistage turbine system, and in which at least part of the composite working fluid is recycled to the superheater stage after passing through a high pressure stage of the turbine and before entering a low pressure stage of the turbine.

19. A method according to claim 3, in which the stripped liquid fraction is divided into first, second and third stripped liquid fraction streams, in which the enriched vapor fraction is mixed with the first stripped liquid fraction stream to produce the rich working fluid fraction, in which the second stripped liquid fraction stream is used as the part of the composite stream comprising the lean working fluid fraction, and in which the third stripped liquid fraction stream is used as the remaining part of the initial composite stream to constitute the condensation stream.

20. A method according to claim 19, in which the compositions of the rich working fluid and lean working fluid fractions are selected so that when heated in the first evaporator stage, the lean working fluid fraction will substantially reach its boiling point, and the rich working fluid fraction will be substantially in the form of a saturated vapor.

21. A method according to claim 1, in which only portion of the initial composite stream is subjected to distillation in the distillation system to produce the enriched vapor fraction, and to produce a stripped liquid fraction from which the enriched vapor fraction has been stripped.

22. A method according to claim 21, in which the enriched vapor fraction is divided into first and second enriched vapor fraction streams, in which the stripped liquid fraction comprises the condensation stream, in which the remaining part of the initial composite stream which is not subjected to distillation is divided into first and second composite streams, and in which the first and second enriched vapor fraction streams are mixed with the first and second composite streams respectively to produce the rich working fluid fraction and the lean working fluid fraction.

23. A method according to claim 22, in which the compositions of the rich working fluid and lean working fluid fractions are selected so that when heated in the first evaporator stage, the lean working fluid fraction will substantially reach its boiling point, and the rich working fluid fraction wil be substantially in the form of a saturated vapor.

* * * * *